US009357854B2

(12) United States Patent
Sundberg et al.

(10) Patent No.: US 9,357,854 B2
(45) Date of Patent: Jun. 7, 2016

(54) JUVENILE WALKER

(71) Applicant: Cosco Management, Inc., Wilmington, DE (US)

(72) Inventors: Brian C Sundberg, Chester, NH (US); Laura K Raffi, Holliston, MA (US); Ward A Fritz, Westwood, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 14/509,224

(22) Filed: Oct. 8, 2014

(65) Prior Publication Data

US 2015/0102574 A1 Apr. 16, 2015

Related U.S. Application Data

(60) Provisional application No. 61/889,106, filed on Oct. 10, 2013.

(51) Int. Cl.
*A47D 13/04* (2006.01)

(52) U.S. Cl.
CPC ..... *A47D 13/043* (2013.01)

(58) Field of Classification Search
CPC ..... A47D 13/043; A47D 13/107; A47D 1/02; B60N 2/3097; B62B 2205/04
See application file for complete search history.

(56) References Cited

U.S. PATENT DOCUMENTS

| | | | | |
|---|---|---|---|---|
| 4,699,392 | A | 10/1987 | Ku | |
| 4,799,700 | A | 1/1989 | Knoedler et al. | |
| 5,071,149 | A | 12/1991 | Perego | |
| 5,203,581 | A | 4/1993 | Jankowski | |
| 5,342,072 | A | 8/1994 | Prasad | |
| 5,409,437 | A | 4/1995 | Lauro et al. | |
| 5,564,724 | A | 10/1996 | Huang | |
| 5,688,211 | A * | 11/1997 | Myers | A47D 13/107 297/5 |
| 5,732,961 | A | 3/1998 | Theodoropoulos | |
| 5,813,681 | A | 9/1998 | Saint et al. | |
| 5,888,178 | A | 3/1999 | Welsh, Jr. | |
| 6,120,045 | A | 9/2000 | Rosko | |
| 6,231,056 | B1 | 5/2001 | Wu | |
| 6,494,815 | B1 | 12/2002 | Welsh, Jr. | |
| 6,863,287 | B2 | 3/2005 | Myers et al. | |
| 7,287,768 | B2 | 10/2007 | Myers et al. | |
| 7,347,432 | B2 | 3/2008 | Myers et al. | |
| 7,819,410 | B2 | 10/2010 | Myers et al. | |
| 2004/0075231 | A1 * | 4/2004 | Hou | A47D 13/043 280/87.051 |
| 2012/0018971 | A1 * | 1/2012 | You | A47D 13/043 280/87.051 |
| 2012/0326409 | A1 | 12/2012 | Corso et al. | |

* cited by examiner

*Primary Examiner* — Bryan Evans
(74) *Attorney, Agent, or Firm* — Barnes & Thornburg LLP

(57) ABSTRACT

A juvenile walker includes a seat supported for movement on a movable base. The elevation of the seat can be changed by a caregiver.

20 Claims, 9 Drawing Sheets

INFANT CARRIER
SECOND SEAT LEG
SECOND SEAT-SUPPORT POST
SECOND LATCH
SEAT UNIT
INFANT CARRIER
FIRST SEAT LEG
SEAT
FIRST SEAT-SUPPORT POST
FIRST LATCH
52R1, 52R2, 52R3

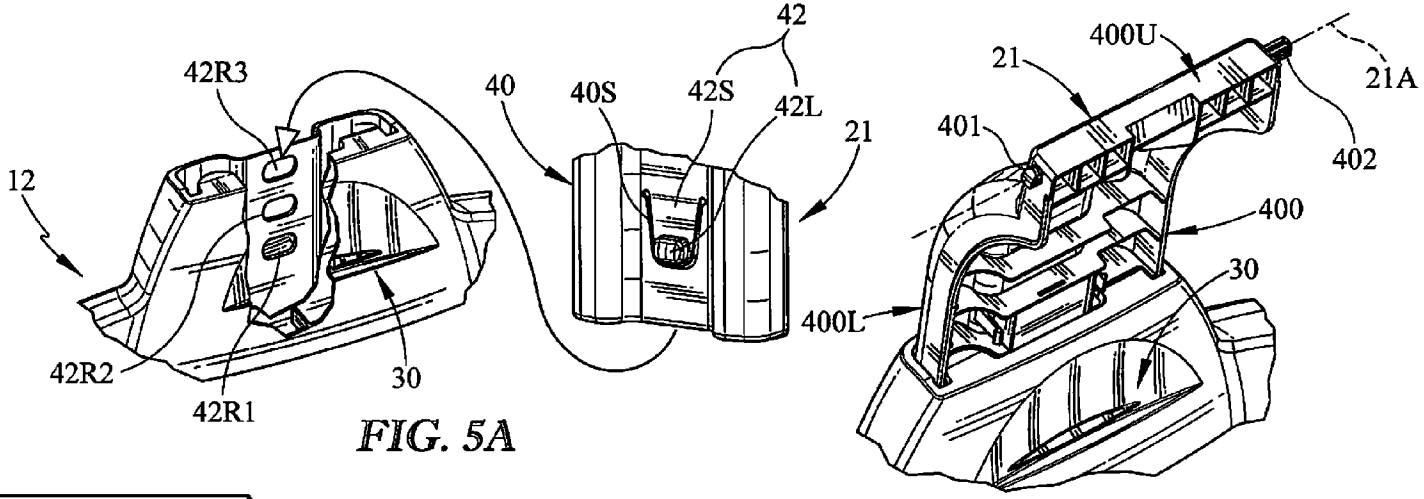
FIG. 5A
FIG. 5B
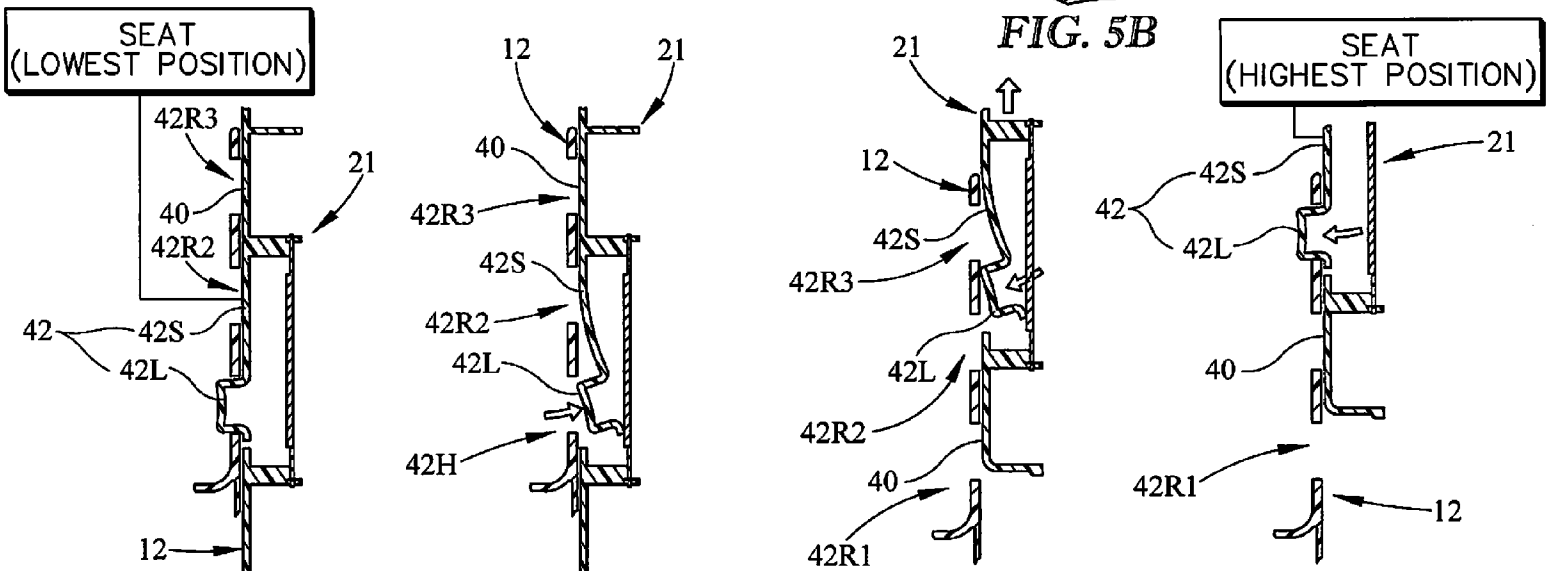
FIG. 9
FIG. 8
FIG. 7
FIG. 6

JUVENILE WALKER

PRIORITY CLAIM

This application claims priority under 35 U.S.C. §119(e) to U.S. Provisional Application Ser. No. 61/889,106, filed Oct. 10, 2013, which is expressly incorporated by reference herein.

BACKGROUND

The present disclosure relates to juvenile walkers, and particularly to juvenile walkers that have movable seats. More particularly, the present disclosure relates to a height-adjustment mechanism for a seat in a juvenile walker.

SUMMARY

A juvenile walker in accordance with the present disclosure includes a seat and a rolling base adapted to roll along ground underlying the rolling base. The seat is adapted to support a young child for movement with the rolling base.

In illustrative embodiments, the juvenile walker includes a seat unit that includes the seat and that can be mated with the rolling base to support the seat in an elevated position above the rolling base. The seat unit is configured to be moved up and down relative to the rolling base at the option of a caregiver to change the elevation of the seat.

In illustrative embodiments, the seat unit comprises a child restraint including the seat, a movable first seat leg coupled to one side of the child restraint, and a movable second seat leg coupled to another side of the child restraint. To achieve an upright use mode of the seat unit, the caregiver moves the first seat leg relative to the seat of the child restraint to mate with one side of the rolling base and moves the second seat leg relative to the seat of the child restraint to mate with another side of the rolling base to cause the seat to be supported in an elevated position above the rolling base. To achieve a collapsed storage mode of the seat unit, the caregiver moves the first and second seat legs to assumed folded positions underneath the child restraint to collapse the seat unit fully and then places the collapsed seat unit in the seat-unit storage space formed in the rolling base where the collapsed seat unit is anchored to the rolling base by means of a snap-fit engagement.

In illustrative embodiments, each seat leg includes a seat-support post and a latch mounted for movement relative to the companion seat-support post. Each seat-support post has a lower portion sized and shaped to slide in a vertical channel formed in a companion post-receiver tower included in the rolling base. Each latch is movable relative to its companion seat-support post to engage a selected one of several latch-receiver apertures formed in the companion post-receiver tower to anchor the seat-support post to the post-receiver tower to establish the elevation of the seat. In illustrative embodiments, each post-receiver tower is formed to include at least a lowest latch-receiver aperture associated with a lowest elevation of the seat above the rolling base and a relatively higher highest latch-receiver aperture associated with a highest elevation of the seat above the rolling base.

In use, each latch is actuated by a caregiver relative to its companion seat-support post to disengage the companion post-receiver tower included in the rolling base so that the seat unit is free to be moved up and down relative to the rolling base. The seat-support post of each seat leg is configured to slide up and down in a channel formed in the companion post-receiver tower included in the rolling base to change the elevation of the seat relative to the rolling base. Once the seat unit is raised or lowered to place the seat in the desired elevation, the latches move automatically (owing, for example, to elasticity of the latches) to engage one of the latch-receiver apertures formed in the companion post-receiver tower so that the companion seat-support post is anchored in a stationary position relative to the companion post-receiver tower.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIGS. 5A-9 demonstrate operation of the first latch included in the first seat leg to engage and disengage latch-receiving apertures formed in the first post-receiving tower to control up-and-down movement of the seat unit relative to the rolling base;

FIG. 5A is a perspective view showing the first post-receiver tower of the rolling base with portions broken away to reveal a first stack of three latch-receiving apertures and showing a lower portion of the first seat-support post included in the first seat leg that is sized to slide downwardly into a channel formed in the first post-receiver tower to place the pivotable first latch included in the first seat leg in close proximity to each of the three latch-receiving apertures;

FIG. 5B is a view similar to FIG. 5A after the first seat leg has been inserted downwardly into the channel formed in the first post-receiver tower;

FIG. 6 is an enlarged sectional view taken along line 6-6 of FIG. 1 showing mating engagement of the pivotable first latch in a first (lowest) latch-receiving aperture formed in the first post-receiver tower to maintain the seat in the lowest seat position;

FIG. 7 is a sectional view similar to FIG. 6 showing disengagement of the pivotable first latch from the first (lowest) latch-receiving aperture in response to an inwardly directed force (represented by the arrow) applied by a caregiver to free the first seat-support post to move up and down in the channel formed in the first post-receiver tower of the rolling base so that the caregiver can change the elevation of the seat in the seat unit;

FIG. 8 is a sectional view similar to FIGS. 6 and 7 showing upward movement of the first seat-support post in the channel formed in the first post-receiver tower of the rolling base;

FIG. 9 is a sectional view similar to FIGS. 6-8 taken along line 9-9 of FIG. 2 showing mating engagement of the first latch in a third (highest) latch-receiving aperture formed in the first post-receiver tower to maintain the seat in the seat unit in the highest seat position;

FIG. 10 is a perspective view showing separation of the seat unit from the underlying rolling base after disengagement of the first latch from the first post-receiver tower and disengagement of the second latch from the second post-receiver tower;

FIG. 11 is a view similar to FIG. 10 showing upward pivotable movement of the first seat leg to lie under the seat;

FIG. 12 is a view similar to FIGS. 19 and 11 showing upward pivotable movement of the second seat leg about a second-leg pivot axis toward the underside of the seat to locate the first seat leg between the seat and the second seat leg to collapse the seat unit fully;

FIG. 13 is a view similar to FIGS. 10-12 showing the collapsed seat unit stored in a seat-unit storage space formed in the rolling base;

DETAILED DESCRIPTION

A juvenile walker 10 is configured to provide mobile seating for a toddler (not shown). Walker 10 includes a rolling base 12 and a seat unit 14 that is height-adjustable as suggested in FIGS. 1 and 2 and is storable in rolling base 12 as suggested in FIGS. 3 and 10-13.

Figures 1, 2, 3:
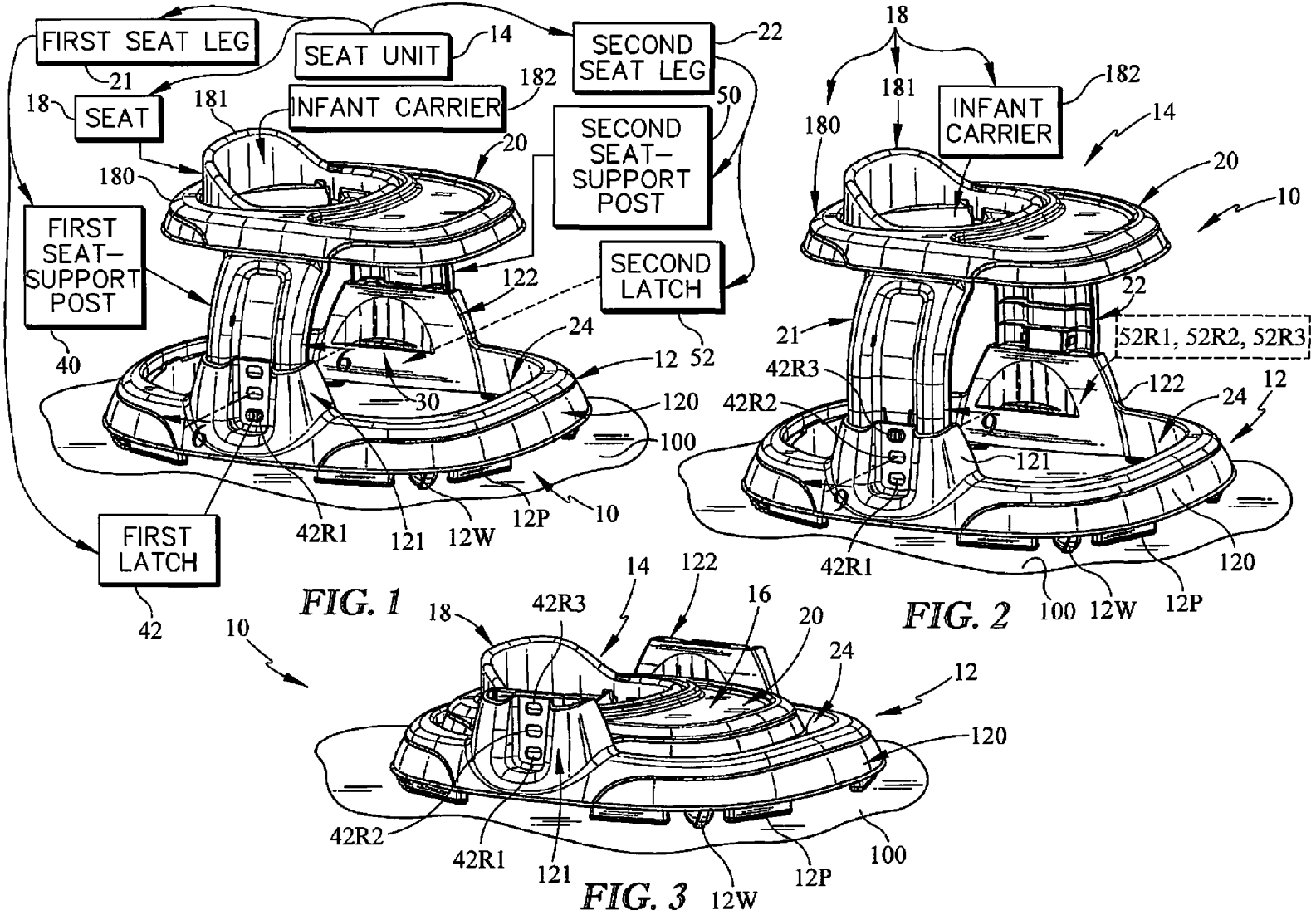
FIG. 1 is a perspective view of a juvenile walker that includes a rolling base and a compactible seat unit configured to nest in the rolling base when not in use as shown in FIG. 3 and shows that the seat unit includes a height-adjustable seat that is adapted to support a young child and that is maintained in a lowest seat position above the underlying rolling base by a seat-height adjustor of the seat unit that includes a first seat-support post, a first latch, a second seat-support post, and a second latch and that is shown in more detail in FIGS. 4 and 14.
FIG. 2 is a view similar to FIG. 1 showing the seat after it has been raised to a highest seat position by moving the first latch coupled to first seat-support post to disengage a companion latch receiver (e.g., aperture) provided in the rolling base to free the first seat-support post to move upwardly relative to the rolling base as suggested in FIGS. 5-9 and moving the second latch coupled to the second seat-support post in a similar manner to free the second seat-support post for upward movement relative to the rolling base so that the seat is elevated further and maintained in the highest-seat position shown in FIG. 2.
FIG. 3 is a perspective view similar to FIGS. 1 and 2 showing the seat unit in a compact collapsed storage mode nested in a storage space provided in the rolling base after the seat unit has been separated from the rolling base by a caregiver and then folded for compact storage as suggested in FIGS. 10-13.
Figure 4:
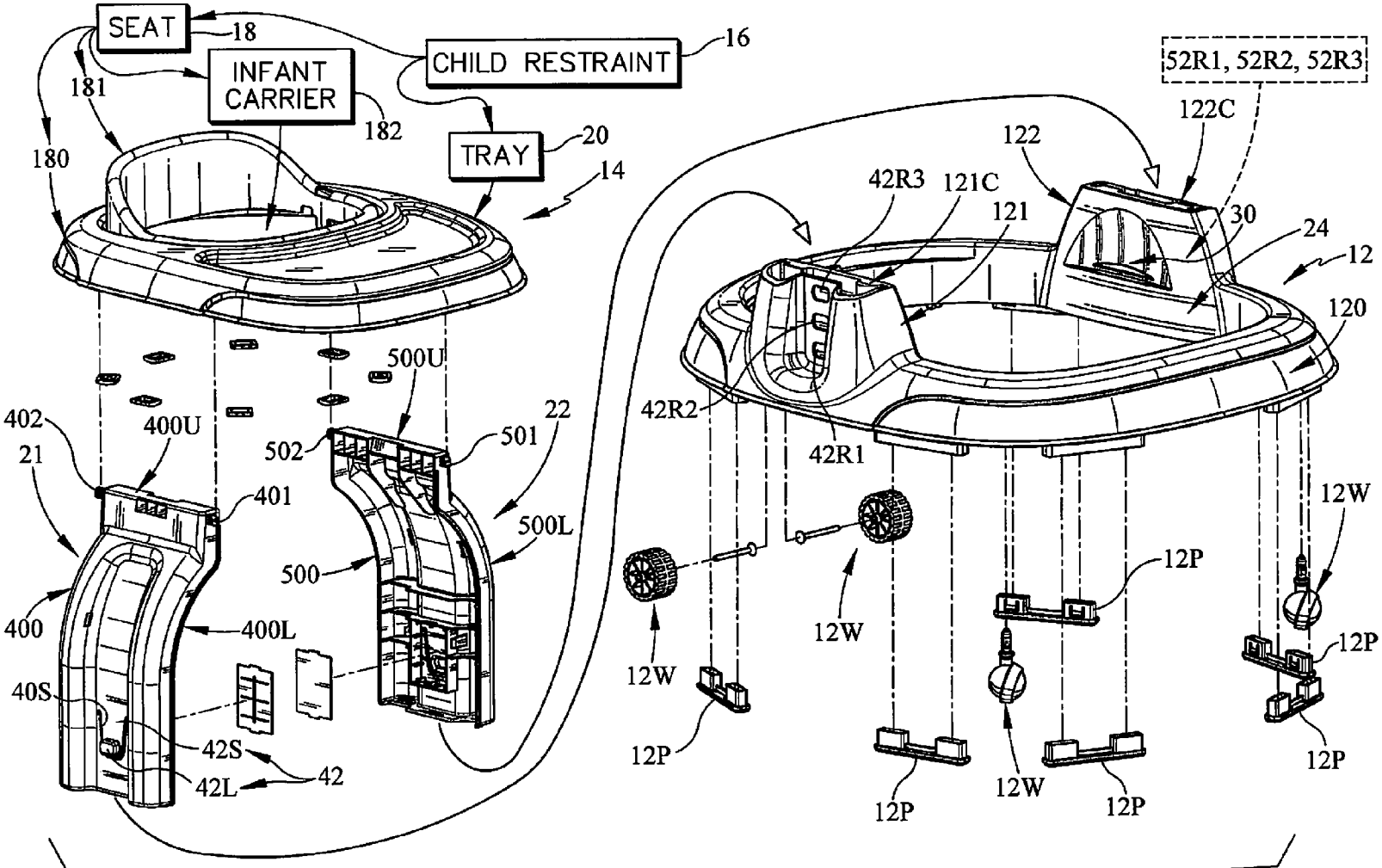
FIG. 4 is an exploded perspective assembly view of the juvenile walker of FIGS. 1-3 showing the seat unit (on the left) and the rolling base (on the right) and showing that the seat includes a carrier frame, a seat back coupled to the carrier frame, and an infant carrier adapted to be coupled to the frame, a tray is coupled to a forward-facing portion of the carrier frame of the seat, a first latch cover plate is associated with a first seat leg shown on the left and configured to provide the first seat-support post and the first latch, and a second latch cover plate is associated with a second seat leg shown on the right and configured to provide the second seat-support post and the second latch and also showing that the rolling base includes a wheel-support rim, wheels adapted to be coupled to the wheel-support rim, several brake pads configured to mate with an underside of the wheel-support rim, an upright first post-receiver tower (on the left) coupled to the wheel-support rim and formed to include a stack of three latch-receiving apertures associated with the first latch, and an upright second post-receiver tower (on the right) coupled to the wheel-support rim and formed to include a stack of three latch-receiving apertures (shown diagrammatically) associated with the second latch.

Seat unit 14 includes a child restraint 16 comprising a seat 18 and a tray 20 coupled to seat 18 as shown, for example, in FIGS. 1 and 4. Seat unit 14 also includes a first seat leg 21 coupled to one side of seat 18 and a second seat leg 22 coupled to another side of seat 18. Lower portions of first and second seat legs 21, 22 mate with rolling base 12 as suggested in FIGS. 4 and 5 and are movable relative to rolling base 12 in upward and downward directions as suggested in FIGS. 6-9 to change the elevation of seat 18 from a lowest seat position shown in FIG. 1 to a highest seat position shown in FIG. 2.

Figures 10, 11, 12, 13:
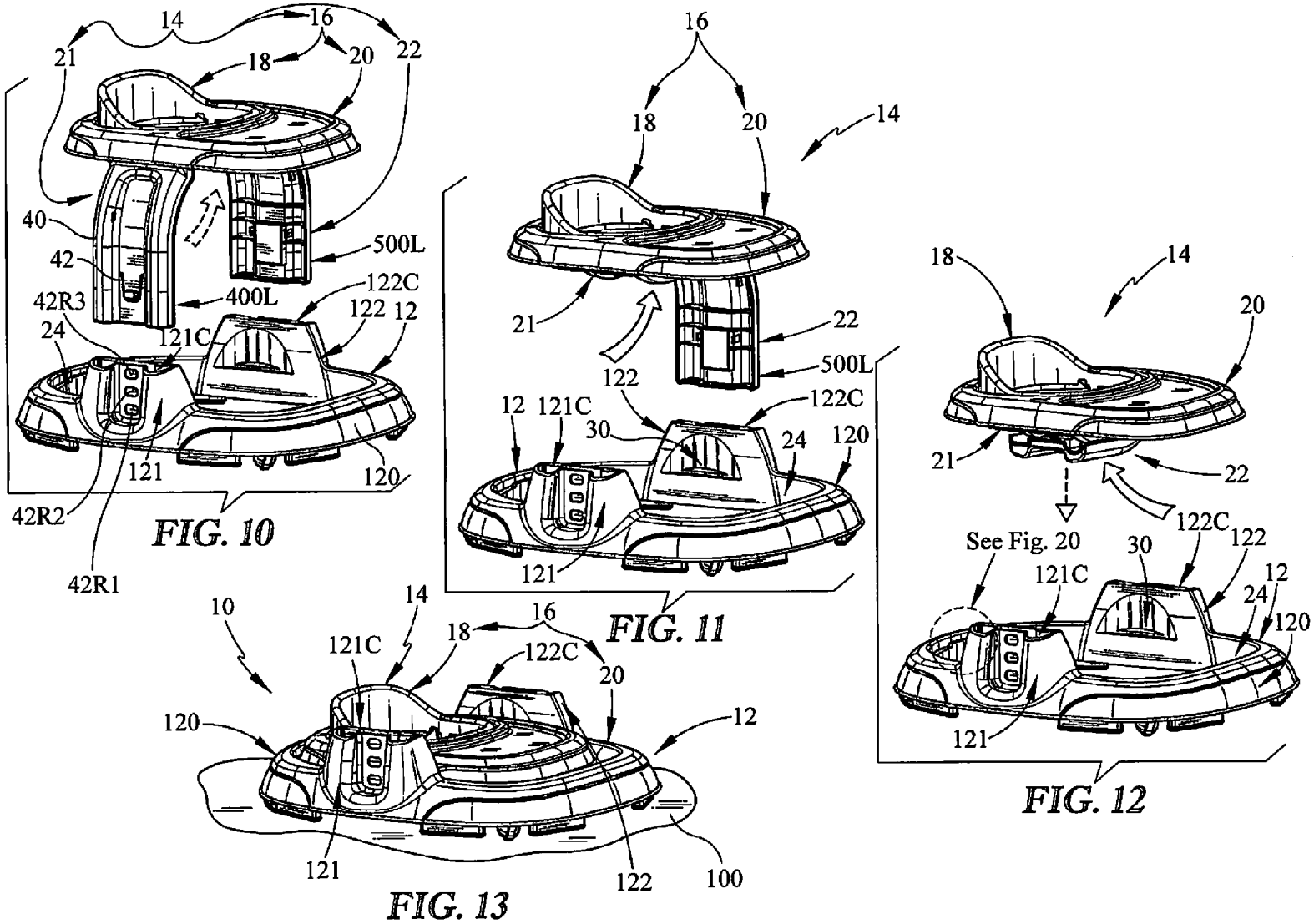
FIGS. 10-13 show a seat-unit compacting sequence in which the seat unit is separated from the rolling base (by a caregiver) and then folded and placed in an underlying seat-unit storage space formed in the rolling base.
Figure 18:
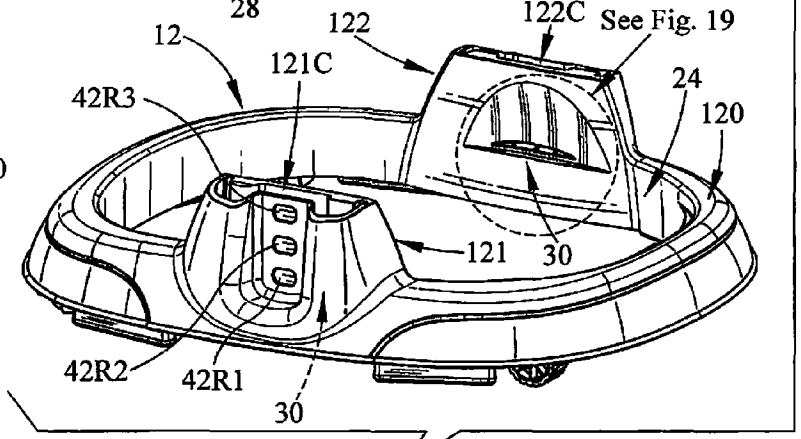
FIG. 18 is a perspective view of the juvenile walker of FIG. 1 with the first and second seat legs omitted.

Seat unit 14 is configured so that it can be stored in rolling base 12 at the option of a caregiver as suggested in FIGS. 10-13, 21, and 22. The lower portions of first and second seat legs 21, 22 can be separated from rolling base 12 by a caregiver as suggested in FIG. 10. Then first and second legs 21, 22 slide downwardly away from seat 18 to be released from anchored engagement with seat 18 as suggested in FIGS. 10A-10E and then pivoted about horizontal pivot axes 21A, 22A as suggested in FIGS. 11 and 12 to assume retracted positions under seat 18 to provide seat unit 14 with a compact size. Once the seat unit 14 has been compacted as shown in FIG. 12, it can be lowered into a seat-unit storage space 24 (see FIG. 18) formed in rolling base 12 as suggested in FIGS. 12 and 13 and locked temporarily in such a collapsed storage mode by engagement of a perimeter rim 28 included in child restraint 16 in a surrounding rim-receiving channel 30 formed in rolling base 12 as suggested in FIGS. 21 and 22.

Seat 18 includes a carrier frame 180, a seat back 181 coupled to carrier frame 180, and an infant carrier 182 coupled to carrier frame 180 as suggested in FIG. 4. In illustrative embodiments, first seat leg 21 is coupled to one side of carrier frame 180 and second seat leg 22 is coupled to an opposite side of carrier frame 180. It is within the scope of this disclosure to provide an infant carrier with any suitable size and shape. It is within the scope of this disclosure also to couple first and second seat legs 21, 22 to a portion of tray 20. Tray 20 is coupled to a forward-facing portion of carrier frame 180 as shown, for example, in FIGS. 1 and 4.

Figure 14:
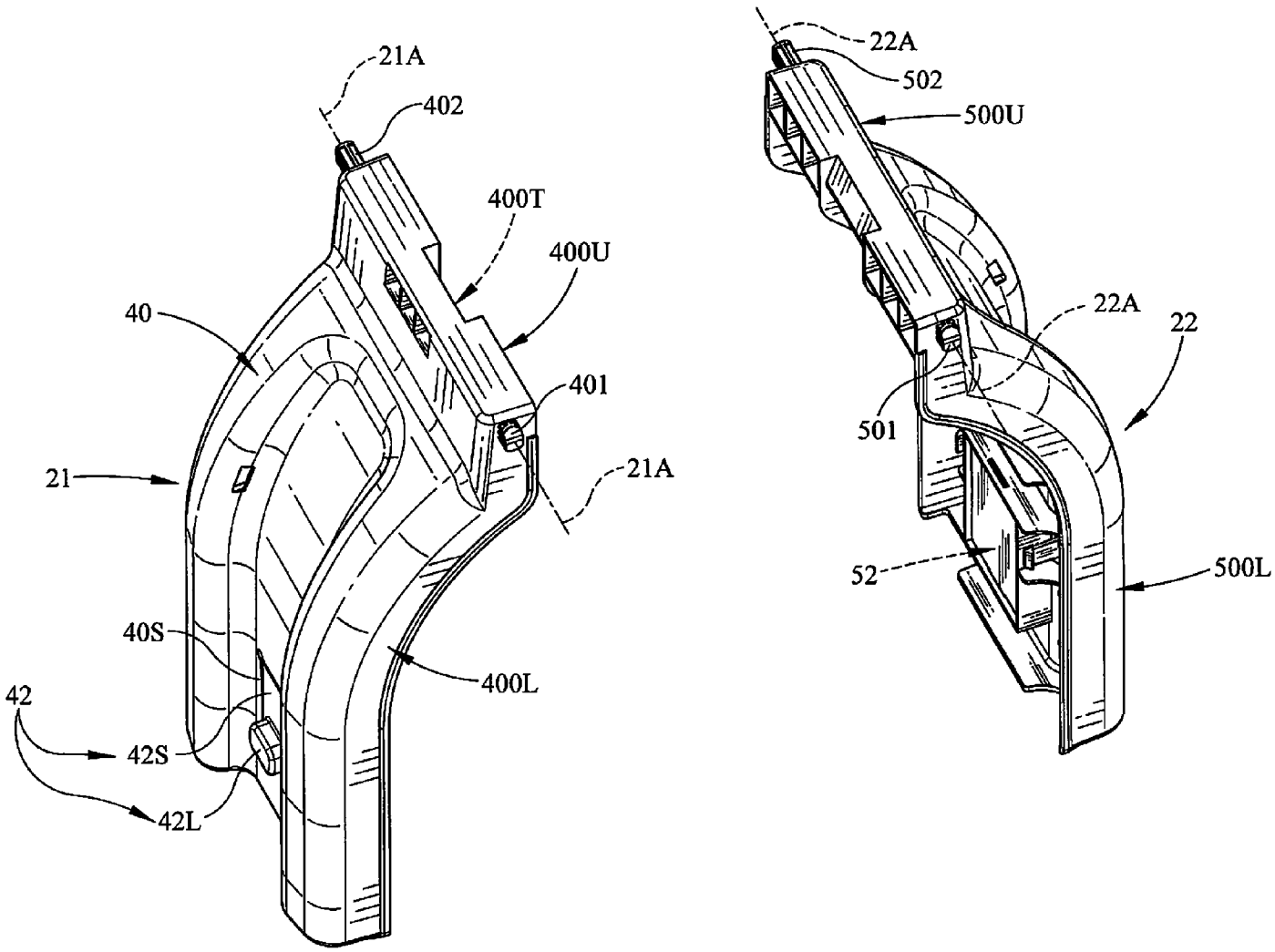
FIG. 14 is an enlarged perspective view of the first and second seat legs included in the compactible seat unit and showing a pivot axis (in phantom) associated with each of the seat legs and showing that each pivot axle included in the first and second leg is chamfered.

First seat leg 21 includes a first seat-support post 40 and a first latch 42 mounted for movement on a lower portion of first seat-support post 40 as shown, for example, in FIGS. 1, 4, and 14. First latch 42 is movable relative to first seat-support post 40 to engage a portion (e.g., one of latch receivers 42R1, 42R2, and 42R3) of rolling base 12 to establish the elevation of seat 18 included in seat unit 14 of child restraint 16.

An upper portion of first seat-support post 40 is mounted to child restraint 16 to allow movement of first seat leg 21 (at the option of a caregiver) relative to child restraint 16 and between an extended position shown in FIGS. 1 and 10 and a refracted position shown in FIG. 11. A lower portion of first seat-support post 40 is configured to mate in sliding relation with rolling base 12 to allow upward and downward sliding movement of first seat-support post 40 (and first seat leg 21) relative to rolling base 12 during a change in elevation of seat 18 relative to rolling base 12 as suggested in FIGS. 1 and 2. The lower portion of first seat-support post 40 is formed to include a latch-receiving space 40S as shown, for example, in FIG. 4 and first latch 42 is arranged to lie and move in that latch-receiving space 40S.

First latch 42 is made of an elastic material and is sized and shaped to engage one of several latch receivers 42R1, 42R2, and 42R3 formed in rolling base 12 and shown in FIGS. 3 and 5A to establish a fixed position of first seat leg 21 relative to rolling base 12 and thus establish the elevation of seat 18 above the ground underlying rolling base 12 as suggested in FIGS. 1 and 2. First latch receiver 42R1 is located to correspond with a lowest elevation (position) of seat 18 as suggested in FIG. 1. Second latch receiver 42R2 is located above first latch receiver 42R2 to correspond with a middle elevation (position) of seat 18. Third latch receiver 42R3 is located above first and second latch receivers 42R1, 42R2 to correspond with a highest elevation (position) of seat 18 as suggested in FIG. 2. In illustrative embodiments, first latch 42 includes an anchor lug 42L sized and shaped to engage each of latch receivers 42R1, 42R2, and 42R3 and a deformable elastic strip 42S having a proximal end coupled to first seat-support post 40 and a free end coupled to anchor lug 42L as shown in FIG. 4. In illustrative embodiments, each latch receiver 42R1, 42R2, and 42R3 is defined by a lug-receiving aperture formed in rolling base 12 and sized to receive anchor lug 42L therein.

First seat-support post 40 includes a pillar 400, a chamfered first pivot axle 401, and a chamfered second pivot axle 402 as shown, for example, in FIGS. 4 and 14. Pillar 400 includes a J-shaped lower portion 400L coupled to first latch 42 and an upper portion 400U coupled to first and second pivot axles 401, 402. First and second pivot axles 401, 402 are arranged to extend in opposite directions along a first-leg pivot axis 21A.

Figure 15:
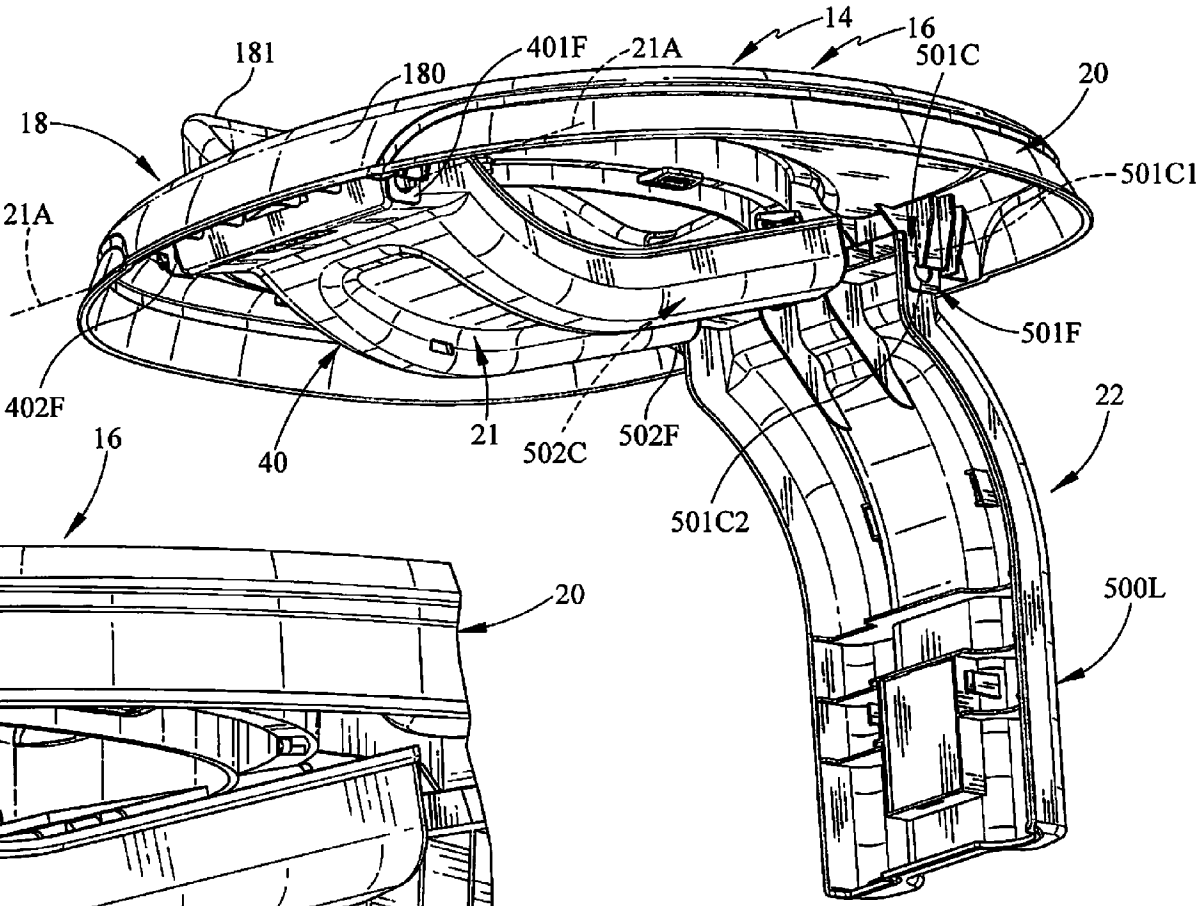
FIG. 15 is an enlarged perspective view of the underside of the partly collapsed seat unit of FIG. 11.
Figure 16:
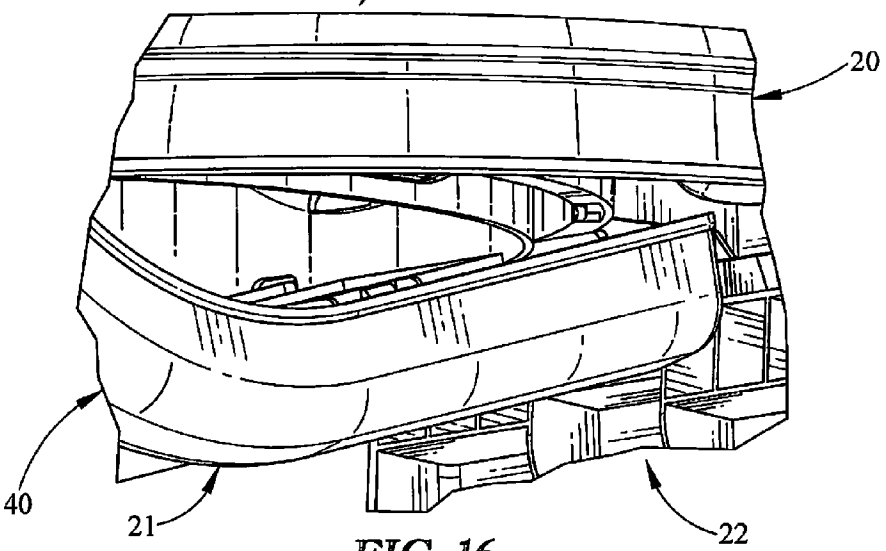
FIG. 16 is an enlarged partial view of the seat unit of FIG. 15.
Figure 17:
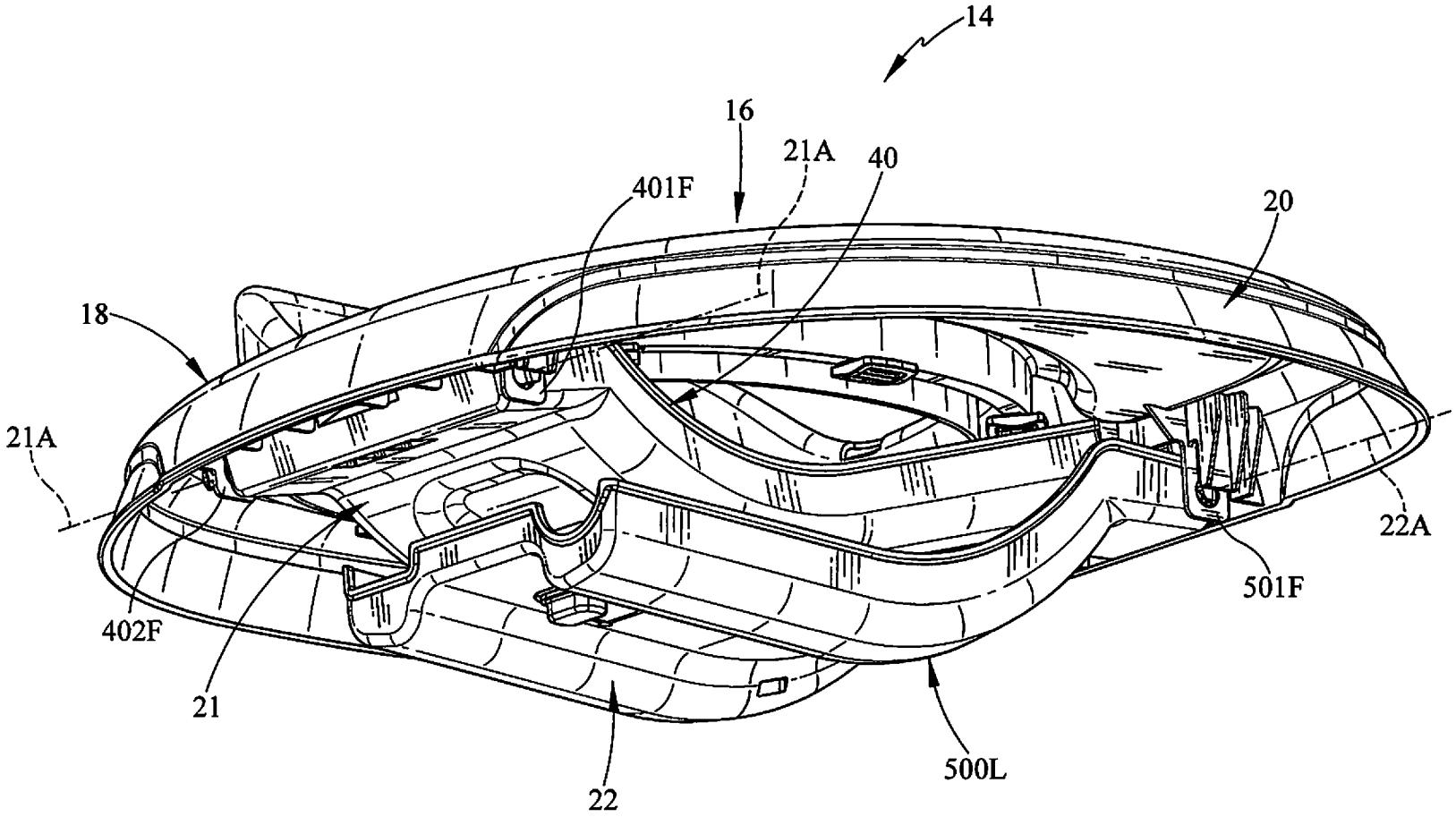
FIG. 17 is an enlarged perspective view of the underside of the fully collapsed seat unit of FIG. 12.

Child restraint 16 of seat unit 14 further includes two downwardly extending spaced-apart axle-support flanges 401F, 402F as shown, for example, in FIGS. 15 and 17. Each axle-support flange 401F, 402F is formed to include, respectively, an axle-receiving channel 401C, 402C. First axle-receiving channel 401C includes an anti-rotation slot 401C1 formed in an upper portion of axle-support flange 401F and an axle-rotation aperture 401C2 formed in a lower portion of axle-support flange 401F as shown, for example, in FIGS. 10A and 10E. Owing to engagement of an external flat surface on chamfered first pivot axle 401 and a companion flat side edge defining a boundary of anti-rotation slot 401C1 of first axle-receiving channel 401C, first pivot axle 401 is blocked from rotation about first-leg pivot axis 21A during upward and downward movement of first pivot axle 401 in anti-rotation slot 401C1. However, once first pivot axle 401 arrives in axle-rotation aperture 401C2 of first axle-receiving channel 401C, then first pivot axle 401 is free to rotate about first-leg pivot axis 21A.

Figures 10A, 10B, 10C, 10D, 10E:
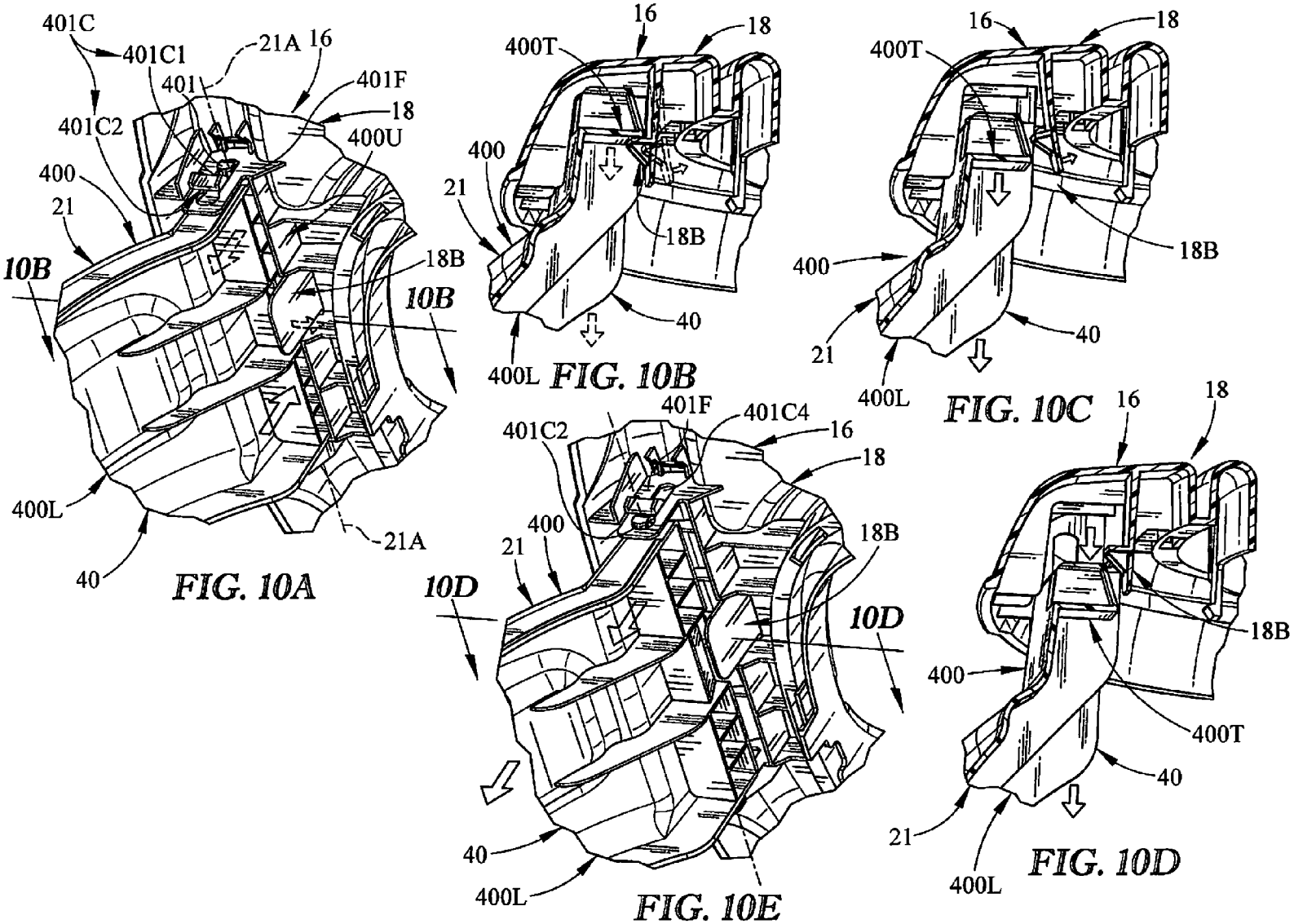
FIG. 10A is a perspective view of a portion of the underside of the seat unit shown in FIG. 1 showing that the first seat leg is locked in a stationary position relative to a seat included in the seat unit.
FIG. 10B is a sectional view taken along line 10B-10B of FIG. 10A showing engagement of an anchor tab included in the first seat leg with an underlying tab-motion blocker included in the seat to lock the first seat leg in the stationary position.
FIG. 10C is a sectional view similar to FIG. 10B showing pivoting motion of the tab-motion blocker away from the anchor tab in response to forces applied to the tab-motion blocker by the anchor tab of a downward moving first seat leg to free the first seat leg for further downward sliding movement away from the seat.
FIG. 10D is a sectional view similar to FIGS. 10B and 10C showing such downward sliding movement of the first seat leg relative to the seat.
FIG. 10E is a perspective view similar to FIG. 10A of the underside of the seat unit shown in FIG. 10 wherein the first seat leg has been lowered relative to the seat to cause a chamfered pivot axle included in the first seat leg to exit an anti-rotation slot formed in an axle-support flange included in the seat and enter an axle-rotation aperture formed in the axle-support flange to free the first seat leg to pivot about a first-leg pivot axis between the extended position shown in FIG. 10 and the retracted position shown in FIG. 11.

A seat-compacting sequence in which seat unit 14 is first separated from rolling base 12 and then folded and placed in an underlying seat-unit storage space formed in rolling base 12 is illustrated in FIGS. 10-13. As part of that seat-compacting sequence, first seat leg 21 is moved by a caregiver from an extended position shown in FIG. 1 to a retracted position folded under seat 18 shown in FIG. 11 using an illustrative sliding and pivoting motion shown, for example, in FIGS. 10A-10E. Initially, first seat leg 21 is locked in a stationary position relative to seat 18 as shown in FIGS. 10A and 10B. Engagement of an anchor tab 400T included in first seat leg 21 with an underlying tab-motion blocker 18B included in seat 18 to lock first seat leg 21 in the stationary position is shown, for example, in FIG. 10B. As suggested in FIG. 10, once seat unit 14 is separated from rolling base 12, a caregiver can pull downwardly on first seat leg 21 to cause camming engagement of anchor tab 400T on tab-motion blocker 18B as suggested in FIGS. 10B and 10C to free first seat leg 21 for further downward sliding movement away from seat 18 as suggested in FIG. 10D. During such sliding movement, the chamfered first pivot axle 401 moves (without any rotation) downwardly in and then exits anti-rotation slot 401C1 formed in axle-support flange 401F and enters axle-rotation aperture 401C2 (where rotation can occur) formed in axle-support flange 401F to free first pivot axle 401 and first seat leg 21 to pivot about a first-seat pivot axis 21A between the extended position shown in FIG. 10 and the retracted (folded) position shown in FIGS. 11 and 15.

Second seat leg 22 includes a second seat-support post 50 and a second latch 52 mounted for movement on a lower portion of second seat-support post 50 as shown, for example, in FIGS. 1 and 4. Second latch 52 is movable relative to second seat-support post 50 to engage a portion (e.g., one of latch receivers 52R1, 52R2, and 52R3) of rolling base 12 to establish the elevation of seat 18 included in seat unit 14 of child restraint 16 of seat unit 14.

An upper portion of second seat-support post 50 is mounted to child restraint 16 to allow movement of second seat leg 22 (at the option of a caregiver) relative to child restraint 16 and between an extended position shown in FIGS. 1, 10, and 11 and a retracted position shown in FIG. 12. A lower portion of second seat-support post 50 is configured to mate in sliding relation with rolling base 12 to allow upward and downward sliding movement of second seat-support post 50 (and second seat leg 22) relative to rolling base 12 during a change in elevation of seat 18 relative to rolling base 12 as suggested in FIGS. 1 and 2.

Second latch 52 is made of an elastic material and is sized and shaped to engage one of several latch receivers 52R1, 52R2, and 52R3 formed in rolling base 12 and shown diagrammatically in FIG. 4 to establish a fixed position of second seat leg 22 relative to rolling base 12 as suggested in FIGS. 1 and 2. In illustrative embodiments, each latch receiver 52R1, 52R2, and 52R3 is defined by a lug-receiving aperture formed in rolling base 12 and similar to latch-receiving apertures 42R1, 42R2, and 42R3.

Second seat-support post 50 includes a pillar 500, a chamfered first pivot axle 501, and a chamfered second pivot axle 502 as shown, for example, in FIGS. 4 and 14. Pillar 500 includes a J-shaped lower portion 500L coupled to first latch 52 and an upper portion 500U coupled to first and second pivot axles 501, 502. First and second pivot axles 501, 502 are arranged to extend in opposite directions along a second-leg pivot axis 22A.

Child restraint 16 of seat unit 14 further includes two downwardly extending spaced-apart axle-support flanges 501F, 502F as shown, for example, in FIGS. 15 and 17. Each axle-support flange 501F, 502F is formed to include, respectively, an axle-receiving channel 501C, 502C. First axle-receiving channel 501C includes an anti-rotation slot 501C1 formed in an upper portion of axle-support flange 501F and an axle-rotation aperture 501C2 formed in a lower portion of axle-support flange 501F as suggested, for example, in FIG. 15. Channels 501C, 502C are similar to channel 401C.

As suggested in FIG. 4, rolling base 12 includes a wheel-support rim 120, an upright first post-receiver tower 121 coupled to wheel-support rim 120 and formed to include a stack of three latch-receiving apertures 42R1, 42R2, and 42R3 associated with first latch 42, and an upright second post-receiver tower 122 coupled to wheel-support rim 120 to lie in spaced-apart relation to first post-receiver tower 121 and to include a stack of three latch-receiving apertures 52R1, 52R2, and 52R3 associated with second latch 52. A lower portion of first seat-support post 40 included in first seat leg 21 is sized to slide downwardly into a channel 121C formed in first post-receiver tower 121 to place the pivotable first latch 42 in close proximity to each of the three latch-receiving apertures 42R1, 42R2, and 42R3 as suggested in FIG. 4. A lower portion of second seat-support post 50 included in second seat leg 22 is sized to slide downwardly into a channel 122C formed in second post-receiver tower 122 to place the pivotable second latch 52 in close proximity to each of the three latch-receiving apertures 52R1, 52R2, and 52R3 as suggested in FIG. 4.

Rolling base 12 further includes wheels 12W adapted to be coupled to wheel-support rim 120 as suggested in FIG. 4 to support rolling base 12 for rolling motion. Rolling base 12 further includes several brake pads 12P configured to mate with an underside of wheel-support rim 120.

Figure 20:
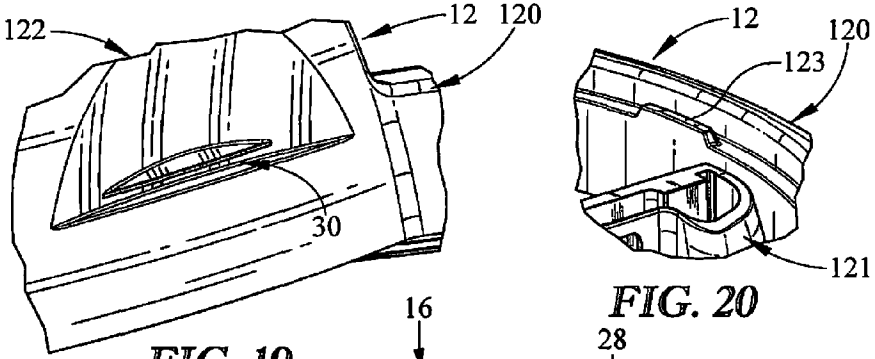
FIG. 20 is an enlarged perspective view taken from the circled region of FIG. 12 from an observation point on the far side of the rolling base that shows an upstanding seat-retainer flange configured to provide means for engaging a portion of the underside of the seat to retain the seat in a fixed position on the rolling base after the child restraint has been nested in the storage space provided in the rolling base as shown in FIG. 13.
Figure 19:
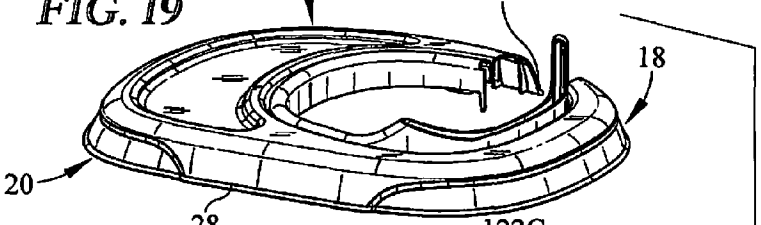
FIG. 19 is an enlarged view of a portion of the second post-receiver tower taken from the circled region of FIG. 18 showing a rim-receiving channel formed to receive a perimeter rim included in the carrier frame of the seat as suggested in FIG. 22.
Figure 21:
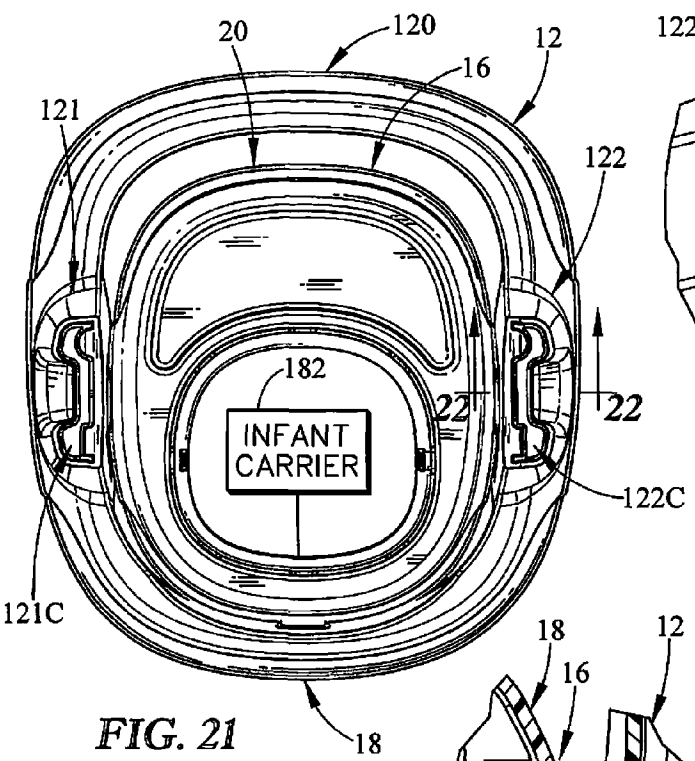
FIG. 21 is a top plan view of the components shown in FIG. 18 after the perimeter ribs of the carrier frame of the seat are mated with the rib-receiving channels formed in the first and second post-receiver towers.
Figure 22:
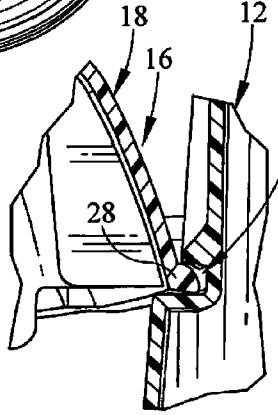
FIG. 22 is an enlarged sectional view taken along lines 22-22 of FIG. 21 showing a perimeter rim of the seat arranged to extend into a companion rib-receiving channel formed in the first post-receiver tower.

Once the folded seat unit 14 is lowered into the seat-unit storage space 24 formed in rolling base 12 as suggested in FIGS. 12 and 13, several illustrative features are provided to retain folded seat unit 14 in that nested storage mode shown in FIGS. 13 and 21. As suggested in FIG. 19, a rim-receiving channel 30 is formed in second post-receiver tower 122 and a perimeter rim 28 included in carrier frame 180 of seat 18 can extend into channel 30 in snap-fit engagement as suggested in FIGS. 21 and 22 to retain seat unit 14 in seat-unit storage space 24 until a caregiver elects to unfold and mount seat unit 14. First post-receiver tower 121 is formed to include a similar rim-receiving channel 30 as suggested in FIG. 18. Also, an upstanding seat-retainer flange 123 shown in FIG. 20 is configured to provide means for engaging a portion of the underside of seat 18 to retain seat 18 in a fixed position on rolling base 12 after child restraint 16 has been nested in seat-unit storage space 24 provided in rolling base 12 as shown, for example, in FIG. 13.

A juvenile walker 10 in accordance with the present disclosure includes a seat 18 and a rolling base 12 adapted to roll along ground 100 underlying the rolling base 12 as suggested in FIGS. 1 and 2. Seat 18 is adapted to support a young child (not shown) for movement with rolling base 12.

In illustrative embodiments, juvenile walker 10 includes a seat unit 14 that includes seat 18 and that can be mated with rolling base 12 to support seat 18 in an elevated position above rolling base 12 as suggested in FIGS. 1 and 2. Seat unit 14 is configured to be moved up and down relative to rolling base 12 at the option of a caregiver to change the elevation of seat 18 as suggested in FIGS. 1, 2, and 6-9.

In illustrative embodiments, seat unit 14 comprises a child restraint 16 including seat 18, a movable first seat leg 21 coupled to one side of child restraint 16, and a movable second seat leg 22 coupled to another side of child restraint 16 as suggested in FIG. 4. To achieve an upright use mode of the seat unit 14, the caregiver moves first seat leg 21 relative to seat 18 of child restraint 16 to mate with one side of rolling base 12 and moves second seat leg 22 relative to seat 18 of child restraint 16 to mate with another side of rolling base 12 to cause seat 18 to be supported in an elevated position above rolling base 12. To achieve a collapsed storage mode of seat unit 14, the caregiver moves first and second seat legs 21, 22 to assumed folded positions underneath child restraint 16 to collapse seat unit 14 fully and then places the collapsed seat unit 14 in the seat-unit storage space 24 formed in rolling base 12 where the collapsed seat unit 14 is anchored to rolling base 12 by means of a snap-fit engagement accomplished by insertion of perimeter rim 28 of child restraint 16 into a surrounding rim-receiving channel 30 formed in rolling base 12 as suggested in FIG. 22.

In illustrative embodiments, each seat leg 21 (22) includes a seat-support post 40 (50) and a latch 42 (52) mounted for movement relative to the companion seat-support post 40 (50). Each seat-support post 40 (50) has a lower portion sized and shaped to slide in a vertical channel 121C (122C) formed in a companion post-receiver tower 121 (122) included in rolling base 12. Each latch 42 (52) is movable relative to its companion seat-support post 40 (50) to engage a selected one of several latch-receiving apertures formed in the companion post-receiver tower 121 (122) to anchor the seat-support post to the post-receiver tower to establish the elevation of seat 18. In illustrative embodiments, each post-receiver tower 121 (122) is formed to include at least a lowest latch-receiving aperture associated with a lowest elevation of seat 18 above rolling base 12 and a relatively higher highest latch-receiving aperture associated with a highest elevation of seat 18 above rolling base 12.

In use, each latch 42 (52) is pivoted by a caregiver relative to its companion seat-support post 40 (50) to disengage the companion post-receiver tower 121 (122) included in rolling base 12 so that seat unit 14 is free to be moved up and down relative to rolling base 12. The seat-support post 40 (50) of each seat leg 21 (22) is configured to slide up and down in a channel 121C (122C) formed in the companion post-receiver tower 121 (122) included in rolling base 12 to change the elevation of seat 18 relative to rolling base 12. Once seat unit 14 is raised or lowered to place seat 18 in the desired elevation, the latches 42 (52) move automatically (owing, for example, to elasticity of the latches) to engage one of the latch-receiving apertures formed in the companion post-receiver tower 121 (122) so that the companion seat-support post 40 (50) is anchored in a stationary position relative to companion post-receiver tower 121 (122).

The invention claimed is:

1. A juvenile walker comprising a rolling base adapted to roll along ground underlying the rolling base and a seat unit including a first seat leg including a first seat-support post, a second seat leg including a second seat-support post, and a child restraint comprising a seat, upper portions of the first and second seat-support posts are coupled to the child restraint, lower portions of the first and second seat-support posts are mounted on the rolling base for movement in upward and downward directions relative to the rolling base and ground underlying the rolling base to change elevation of the seat relative to the rolling base to achieve an upright use mode of the seat unit, wherein the rolling base is configured to include means for holding the seat unit in a stationary seat-storage position in a seat-unit storage space after separation of the lower portions of the first and second seat-support posts from the rolling base to achieve a collapsed storage mode of the seat unit wherein the first and second seat-support posts are arranged to assume folded positions under the seat of the child restraint in which the lower portion of the first seat-support post is arranged to lie in a space provided between the seat and the lower portion of the second seat-support post.

2. A juvenile walker comprising a rolling base adapted to roll along ground underlying the rolling base an a seat unit including a first sear leg including a first seat-support post, a second seat leg including a second seat-support post, and a child restraint comprising a seat, upper portions of the first and second seat-support posts are coupled to the child restraint, lower portions of the first and second seat-support posts are mounted on the rolling base for movement in upwawrd and downward directions relative to the rolling base and ground underlying the rolling base to change elevation of the seat relative to the rolling base to achieve an upright use mode of the seat unit, seat-storage position in a seat-unit storage space after separation of the lower portions of the first and second seat-supported posts from the rolling base to achieve a collapsed storage mode of the seat unit, wherein each of the first and second seat-support posts is pivotably coupled to the child restraint for pivotable movement about a leg-pivot axis between an extended position in the upright use mode and a retracted position in the collapsed storage mode and the first and second seat-support posts are arranged to assume folded positions under the seat of the child restraint in the collapsed storage mode in which the lower portion of the first seat-support post is arranged to lie in a space provided between the seat and the lower portion of the second seat-support post.

3. The juvenile walker of claim 2, wherein the rolling base includes a ring-shaped wheel-support rim formed to include the seat-unit storage space, wheels coupled to the wheel-support rim, and restraint-engagement means for engaging a first side of the child restraint and an opposite second side of the child restraint to support the seat unit in the stationary seat-storage position in the seat-unit storage space in the collapsed storage mode of the seat unit.

4. The juvenile walker of claim 3, wherein the rolling base further includes a first post-receiver tower coupled to one side of the ring-shaped wheel-support ring and engaged to the lower portion of the first seat-support post in the upright use mode of the seat unit to support the first seat-support post for slidable up-and-down movement on the first post-receiver tower, a second post-receiver tower coupled to an opposite side of the ring-shaped wheel-support ring and engaged to the lower portion of the second seat-support post in the upright use mode of the seat unit to support the second seat-support post for slidable up-and-down movement on the second post-receiver tower, and the restraint-engagement means includes a first rim-receiving channel formed in the first post-receiver tower to open into the seat-unit storage space and engaged to a first portion of the ring-shaped wheel-support rim in the collapsed storage mode of the seat unit and a second rim-receiving channel formed in the second post-receiver tower to open into the seat-unit storage space and face toward the first rim-receiving channel and engaged to a second portion of the ring-shaped wheel-support rim.

5. The juvenile walker of claim 2, wherein the first seat-support post includes a pillar and a chamfered pivot axle coupled to the pillar and arranged to extend along the leg pivot axis of the first seat-support post, the pillar is mounted on the rolling base for up-and-down movement relative to the rolling base in the upright use mode of the seat unit, the child restraint includes an axle-support flange located along one side of the seat to lie adjacent to the upper portion of the first seat-support post, the axle-support flange is formed to include an axle-receiving channel receiving the chamfered pivot axle for movement therein and having an anti-rotation slot formed in an upper portion of the axle-support flange and an axle-rotation aperture formed in a lower portion of the axle-support flange to locate the axle-rotation slot between the anti-rotation slot and the rolling base in the upright use mode of the seat unit, the chamfered pivot axle is arranged to lie in the anti-rotation slot in the upright use mode of the seat unit to cause an external flat surface on the chamfered pivot axle to engage a companion flat side edge defining a boundary of the anti-rotation slot to block pivotable movement of the first seat-support post relative to the child restraint about the leg pivot axis of the first seat-support post in the upright use mode of the seat unit, and the chamfered pivot axle is arranged to lie in the axle-rotation slot in the collapsed storage mode of the seat unit to allow the chamfered pivot axle to rotate freely about the leg pivot axis of the first seat-support post to allow pivoting movement of the first seat-support post to assume a folded position under the seat to establish the collapsed storage mode of the seat unit.

6. The juvenile walker of claim 5, wherein the first seat leg further includes an anchor tab coupled to the upper portion of the first seat-support post and the child restraint further comprises a tab-motion blocker made of an elastic material that is biased to engage the anchor tab first seat-support post to lock the first seat leg in the extended position.

7. The juvenile walker of claim 2, wherein the first seat leg further includes an anchor tab coupled to the upper portion of the first seat-support post and the child restraint further comprises a tab-motion blocker made of an elastic material that is biased to engage the anchor tab first seat-support post to lock the first seat leg in the extended position.

8. The juvenile walker of claim 1, wherein the upper portion of the first seat-support post is mounted on the child restraint to support the first seat leg for movement relative to the child restraint between a vertical seat-elevating extended position oriented to mate the lower portion of the first seat-support post with the rolling base to elevate the seat above the rolling base and a horizontal seat-lowering retracted position oriented to lie under the seat when the seat unit is held in the stationary seat-storage position in the seat-storage space formed in the rolling base, the upper portion of the second seat-support post is mounted on the child restraint to support the second seat leg for movement relative to the child restraint between a vertical seat-elevating extended position oriented to mate the lower portion of the second seat-support post with the rolling base to elevate the seat above the rolling base and a horizontal seat-lowering retracted position oriented to lie under the seat when the seat unit is held in the stationary seat-storage position in the seat-storage space formed in the rolling base, and the first and second seat-support posts are located in the horizontal seat-lowering retracted positions under the seat and between the seat and ground underlying the rolling base when the seat unit is retained in the stationary seat-storage position in the seat-unit storage space after separation of the lower portions of the first and second seat legs from the rolling base.

9. The juvenile seat of claim 8, wherein the rolling base includes a wheel-support rim, wheels coupled to the wheel-support rim and arranged to roll on ground underlying the rolling base, an upright first post-receiver tower coupled to the wheel-support rim and arranged to extend upwardly away from the wheel-support rim and engage the lower portion of the first seat-support post of the first seat leg to support the first seat leg relative to the rolling base in the vertical seat-elevating extended position, and an upright second post-receiver tower coupled to the wheel-support rim and arranged to extend upwardly from the wheel-support rim and lie in laterally spaced-apart relation to the upright second post-receiver tower to engage the lower portion of the second seat-support post of the second seat leg to support the second seat leg relative to the rolling base in the vertical seat-elevating extended position and the seat in an elevated position overlying the seat-unit storage space, and the seat-unit storage space is located between the first and second post-receiver towers.

10. The juvenile seat of claim 9, wherein each of the first and second post-receiver towers is formed to include a rim-receiving channel opening into the seat-unit storage space and the seat unit further includes a perimeter rim arranged to extend into the rim-receiving channel formed in each of the first and second post-receiver towers in snap-fit engagement to retain the seat unit in the seat-unit storage space until a caregiver elects to remove the seat unit from the seat-unit storage space and mount the first and second seat-support posts in the first and second post-receiver towers to elevate the seat above the rolling base.

11. The juvenile seat of claim 10, wherein the seat includes a carrier frame, a seat back coupled to the carrier frame, and an infant carrier coupled to the carrier frame to lie adjacent to and under the seat back, and the perimeter rim is included in the carrier frame.

12. The juvenile seat of claim 10, wherein the rolling base further includes an upstanding seat-retainer flange coupled to the wheel-support rim and configured to provide means for engaging a portion of the underside of the seat to retain the seat in a fixed position on the rolling base after the seat unit has been nested in the seat-unit storage space provided in the rolling base.

13. The juvenile seat of claim 9, wherein the rolling base further includes an upstanding seat-retainer flange coupled to the wheel-support rim and configured to provide means for engaging a portion of the underside of the seat to retain the seat in a fixed position on the rolling base after the seat unit has been nested in the seat-unit storage space provided in the rolling base.

14. The juvenile seat of claim 9, wherein the lower portion of the first seat-support post is configured to mate in sliding relation with the first post-receiver tower when the first seat leg occupies the vertical seat-elevating extended position to allow upward and downward sliding movement of the first seat-support post relative to the first post-receiver tower and the wheel-support rim during a change in elevation of the seat relative to the wheel-support rim, the lower portion of the second seat-support post is configured to mate in sliding relation with the second post-receiver tower when the second seat leg occupies the vertical seat-elevating extended position to allow upward and downward sliding movement of the second seat-support post relative to the second post-receiver tower and the wheel-support rim during a change in elevation of the seat relative to the wheel-support rim, the first seat-support post is formed to include a first latch receiver arranged to lie at a first elevation above ground underlying the rolling base and a second latch receiver arranged to lie at a relatively greater second elevation above ground underlying the rolling base, and the first seat leg further includes a first latch mounted for movement on the lower portion of the first seat-support post for movement relative to the first seat-support post to engage one of the first and second latch receivers to determine the elevation of the seat relative to the wheel-support rim.

15. The juvenile seat of claim 14, wherein the first post-receiver tower is formed to include a channel, a first latch-receiving aperture opening into the channel to define the first latch receiver, and a second latch-receiving aperture opening into the channel to define the second latch receiver, the first latch includes an anchor lug sized and shaped to extend into each of the first and second latch-receiving apertures and a deformable elastic strip having a proximal end coupled to the first seat-support post and a free end coupled to the anchor lug and extending into the channel formed in the first post-receiver tower when the lower portion of the first seat-support post extends into the channel formed in the first post-receiver tower, and the deformable elastic strip is configured to provide means for yieldably urging the anchor lug into the first latch-receiving aperture to establish a first elevation of the seat and into the second latch-receiving aperture to establish a relatively higher second elevation of the seat.

16. The juvenile walker of claim 2, wherein the first seat-support post includes a pillar mounted on the rolling base for movement in upward and downward directions and a chamfered pivot axle arranged to extend laterally along a first-leg pivot axis in a side direction that is generally orthogonal to the upward and downward directions, child restraint includes an axle-support flange formed to include an axle-receiving channel receiving the chamfered pivot axle therein having an anti-rotation slot formed in an upper portion of the axle-support flange and an axle-rotation aperture formed in a lower portion of the axle-support flange, and owing to engagement of an external flat surface on the chamfered pivot axle and a companion flat side edge defining a boundary of the anti-rotation slot of the axle-receiving channel, the chamfered pivot axle is blocked from rotation about the first-leg pivot axis during upward and downward movement of the chamfered pivot axle in the anti-rotation slot yet once the chamfered pivot axle arrives in the axle-rotation aperture of the axle-receiving channel the chamfered pivot axle is free to rotate about the first-leg pivot axis to allow movement of the first leg relative to the child restraint between the vertical seat-elevating extended position and the horizontal seat-lowering retracted position.

17. The juvenile walker of claim 16, wherein the first seat leg further includes an anchor tab coupled to the upper portion of the first seat-support post and the child restraint further comprises a tab-motion blocker made of an elastic material that is biased to engage the anchor tab first seat-support post to lock the first seat leg in the vertical seat-elevating extended position.

18. The juvenile walker of claim 17, wherein the anchor tab includes cam means for moving the tab-motion blocker relative to the seat to disengage the anchor tab in response to downward movement of the first leg away from the child restraint after removal of the seat unit from the rolling base to free the first seat leg for further downward sliding movement away from the seat to cause the chamfered pivot axle to move without any rotation downwardly in and then out of the anti-rotation slot formed in the axle-support flange to free the pivot axle and first seat leg to pivot about the first-seat pivot axis between the vertical seat-elevating extending position and the horizontal seat-lowering retracted position.

19. A juvenile walker comprising a rolling base adapted to roll along ground underlying the rolling base, the rolling base including a ring-shaped wheel-support rim, wheels coupled to the wheel-support rim, a first post-receiver tower coupled to one side of the wheel-support rim and arranged to extend upwardly away from ground underlying the rolling base, and a second post-receiver tower coupled to an opposite side of the wheel-support rim and arranged to extend upwardly away from ground underlying the rolling base and to lie in spaced-apart relation to the first post-receiver tower, and a seat unit including a first seat leg having a first seat-support post arranged to extend downwardly into a channel formed in the first post-receiver tower for up-and-down movement therein, a second seat leg having a second seat-support post arranged to extend downwardly into a channel formed in the second post-receiver tower for up-and-down movement therein, and a child restraint including a seat and mating with the first and second seat-support posts for up-and-down movement therewith relative to the wheel-support rim to change elevation of the seat relative to the wheel-support rim and ground underlying the rolling base, wherein the first post-receiver tower is formed to include a first latch-receiving aperture lying at a first elevation above ground underlying the rolling base and opening into the channel formed in the first post-receiver tower and a second latch-receiving aperture lying at a relatively higher second elevation above ground underlying the rolling base and opening into the channel formed in the first post-receiver tower and the first seat leg further includes a first latch mounted for movement on a lower portion of the first seat-support post in the channel formed in the first post-receiver tower to engage one of the first and second latch-receiving apertures to determine the elevation of the seat relative to the wheel-support rim, and wherein the first seat leg includes a lock for locking the first seat leg in position for said up-and-down movement and the first seat leg is moveable away from the seat for unlocking the first seat leg for movement to a storage mode.

20. The juvenile walker of claim 19, wherein the first latch includes an anchor lug sized and shaped to extend into each of the first and second latch-receiving apertures and a deformable elastic strip lying in the channel formed in the first post-receiver tower and having a proximal end coupled to the first seat-support post and a free end coupled to the anchor lug, and the deformable elastic strip is arranged to yieldably urge the anchor lug into the first latch-receiving aperture to establish a first elevation of the seat and into the second latch-receiving aperture to establish a relatively higher second elevation of the seat.

* * * * *